US007537086B2

(12) United States Patent
Bakker

(10) Patent No.: US 7,537,086 B2
(45) Date of Patent: May 26, 2009

(54) SAFETY INSTALLATION FOR THE EDGE OF A ROOF

(75) Inventor: Johannes Bakker, Venlo (NL)

(73) Assignee: Roof Safety Systems, B.V. (NL)

( * ) Notice: Subject to any disclaimer, the term of this patent is extended or adjusted under 35 U.S.C. 154(b) by 596 days.

(21) Appl. No.: 10/512,168

(22) PCT Filed: Apr. 23, 2003

(86) PCT No.: PCT/NL03/00300

§ 371 (c)(1),
(2), (4) Date: Jun. 21, 2005

(87) PCT Pub. No.: WO03/093609

PCT Pub. Date: Nov. 13, 2003

(65) Prior Publication Data

US 2005/0235583 A1 Oct. 27, 2005

(30) Foreign Application Priority Data

Apr. 29, 2002 (NL) ..... 1020502

(51) Int. Cl.
*E04G 3/00* (2006.01)

(52) U.S. Cl. ..... 182/82; 182/150; 248/235; 52/DIG. 12

(58) Field of Classification Search ..... 182/82, 182/150, 87, 90, 92; 248/235; 52/DIG. 12
See application file for complete search history.

(56) References Cited

U.S. PATENT DOCUMENTS 2,121,704 A * 6/1938 Leeworthy ..... 248/235
3,526,296 A * 9/1970 Stevens ..... 182/45
3,595,510 A * 7/1971 Hutchinson ..... 248/175
4,122,916 A * 10/1978 Strobel ..... 182/82
4,957,185 A * 9/1990 Courchesne et al. ..... 182/150
5,067,586 A * 11/1991 Myers ..... 182/45
5,135,078 A * 8/1992 Bell et al. ..... 182/142
5,503,358 A * 4/1996 Lapp ..... 248/235
5,524,727 A * 6/1996 Yennie, Jr. ..... 182/82
5,570,559 A * 11/1996 Lewis ..... 52/749.12
6,003,631 A * 12/1999 Knauth ..... 182/82
6,325,348 B1 * 12/2001 Turner ..... 248/235

FOREIGN PATENT DOCUMENTS

| | | |
|---|---|---|
| CH | 262 727 A | 7/1968 |
| DE | 100 34 066 | 1/2002 |
| FR | 91 855 | 7/1968 |
| NL | 8 800 985 | 11/1989 |

OTHER PUBLICATIONS

International Search Report of Jul. 11, 2003.

* cited by examiner

*Primary Examiner*—Richard E Chilcot, Jr.
*Assistant Examiner*—Chi Q Nguyen
(74) *Attorney, Agent, or Firm*—Greenberg Traurig, LLP

(57) ABSTRACT

Safety installation for the edge of a roof consisting of a number of vertical uprights, with horizontal fencing/railing, to be fitted close to the edge of the roof, for example in a gutter, each upright being provided with an arm that extends downwards therefrom in the use position and is provided with a support point. There is an auxiliary arm that is provided with an engagement surface that engages underneath the edge of the roof. This auxiliary arm can be fixed to the arm such that it can hinge and locking means can be present for securing the non-locking position to facilitate dismantling.

10 Claims, 6 Drawing Sheets

SAFETY INSTALLATION FOR THE EDGE OF A ROOF

The present invention relates to a safety installation for the edge of a roof comprising an upright that extends essentially vertically in the use position and is equipped for joining a railing thereto and is provided at the free bottom end with a first bearing surface, an arm that is joined to said upright and extends downwards therefrom, which arm is provided at the free end with a second bearing surface, securing means designed to engage, together with said first bearing surface of said upright, on an edge of a roof or gutter from below and from above, respectively.

Such a safety installation for the edge of a roof is disclosed in NL-A 8800985.

Safety installations for the edge of a roof are used when carrying out work on the roof that takes a prolonged period. Requirements with regard to the safety of the construction on a roof or other construction a relatively great height from the ground are imposed by the authorities.

In the case of safety installations for the edge of a roof a distinction must be made between permanent safety installations and safety installations that are fitted temporarily. The present invention relates to safety installations that are fitted temporarily, which, for example, are used when replacing roof covering and in the case of other work on (horizontal) roofs.

Netherlands Laid Open Application 8800985 discloses a safety installation for the edge of a roof where a U-shaped construction extends on the upright, which U-shaped construction can be fitted around a gutter or the like. On the underside there is a manually adjustable securing device that can be moved into a position precisely underneath the first bearing surface in order thus to accommodate a gutter clamped between them.

Apart from the fact that the lower securing means acting on the gutter are not easily vertically adjustable, a construction of this type functions only in the case of roofs provided with gutters having a flat base. After all, if the base of the gutter is curved unequivocal securing will no longer be easily possible. Moreover, a construction of this type does not work at all in the case of flat roofs. After all, with flat roofs it is not possible to be able to position the securing means horizontally against the first bearing surface.

SUMMARY

The aim of the present invention is to provide a safety installation for the edge of a roof which can be used both with sloping and with flat roofs irrespective of the size of the overhang and irrespective of the shape of the gutter.

Moreover, a further aim of the present invention is to provide a safety installation for the edge of a roof that cannot unintentionally be rendered inoperative and can easily be fitted and removed. The aim is also to provide the safety installation for the edge of a roof that is simple to fit and has a low weight. Moreover, it must be possible to fit this installation both on flat roofs and on sloping roofs that, for example, terminate in a gutter.

Upright safety installations for the edge of a roof have the advantage that these can sometimes be fitted easily, but they also have the associated disadvantage that they can be removed equally easily, including in unintentional cases. Other safe constructions are particularly difficult to fit and/or to remove.

A further aim of the present invention is to provide a safety installation for the edge of a roof that can be fitted and removed in a simple manner.

The aims described above are achieved with a safety installation for the edge of a roof as described above wherein said securing means are adjustable in the horizontal direction with respect to said first bearing surface.

According to the present invention the securing means can be moved in the horizontal direction with respect to the first bearing surface. When used in a gutter, such as in the case of a sloping roof, it is, in principle, possible to position the engagement surface of the securing means opposite the bearing surface. If the edge of the roof is relatively broad with a small overhang the securing means can be positioned further to the outside with respect to the building concerned than the first bearing surface. Incidentally, it is not always necessary that the securing means exert a clamping hold. After all, these securing means are mainly present to prevent the upright moving out of the seating therefor, such as a gutter or the edge of a roof. This is, in particular, a risk in the case of storms and the like. Slight movement is, however, permitted as long as this does not lead to detachment of the construction. Using the invention the safety installation for the edge of a roof can easily be adapted to a wide variety of types of roofs with differing overhangs.

According to an advantageous embodiment this safety device to prevent upward movement of the safety installation for the edge of a roof is constructed as an auxiliary arm. According to a particular embodiment of the invention this auxiliary arm is joined to the arm described above, which bears on the outside wall, such that it can hinge. This auxiliary arm is provided with one or more engagement surfaces for engaging underneath a gutter or the like. Moreover, locking means can be present to lock the auxiliary arm either in the locking position or in the non-locking position. According to a particular embodiment driving means such as a spring are present which drive the auxiliary arm into the locking position. In such a case it is necessary that the locking means in any event lock in the non-securing position to enable intentional removal of the safety installation for the edge of a roof.

According to a further advantageous embodiment of the invention the distance between the first and second bearing surface is adjustable in both the horizontal direction and the vertical direction. As a result provision can be made for adaptation to the local conditions, such as the presence of a window, a recessed or projecting part or the like on the outside wall.

According to an advantageous embodiment of the present invention the tilting moment generated on the vertical upright is transferred to a bearing surface that is located a relatively great distance away and preferably bears on the outside wall or the like of a building. This bearing surface can consist of a dish-like part that is fitted such that it can pivot in various directions with respect to the arm so as always to guarantee full-surface contact with an outside wall or the like. From above the safety installation for the edge of a roof bears on a gutter, behind an edge of the roof or the like. According to an advantageous embodiment of the invention the distance between the support point on the roof/roof gutter—outside wall support point is many times, that is to say 5-20 times, greater than the distance between these support points in the horizontal direction. A value of 1-3 m may be mentioned as an example of the distance between the bearing surfaces in the vertical direction. Preferably, the arm is of telescopic construction so that obstacles or non-load-bearing parts such as window/door areas can be avoided and the support point described above can be chosen as desired.

According to a further advantageous embodiment of the invention the first bearing surface comprises a wheel. Thus, it is possible to install the safety installation for the edge of a roof only at the location where the work is being carried out and simply to move it along the outside wall as work progresses by rolling of the wheel.

The invention also relates to a system consisting of a number of safety installations for the edge of a roof described above, between which a railing has been fitted. According to a preferred embodiment, this railing comprises a barrier-like construction that can be hooked into the safety installations for the edge of a roof in a simple manner. According to a further advantageous embodiment, the fencing-like construction is of V-shaped or kinked symmetrical construction, so that this kinks inwards or outwards with respect to the edge of the roof in the upward direction. Optimum positioning of the V-shaped barrier can thus be provided, irrespective of the conditions.

The invention will be explained in more detail below with reference to an illustrative embodiment shown in the drawings. In the drawings:

DETAILED DESCRIPTION

Figure 1:
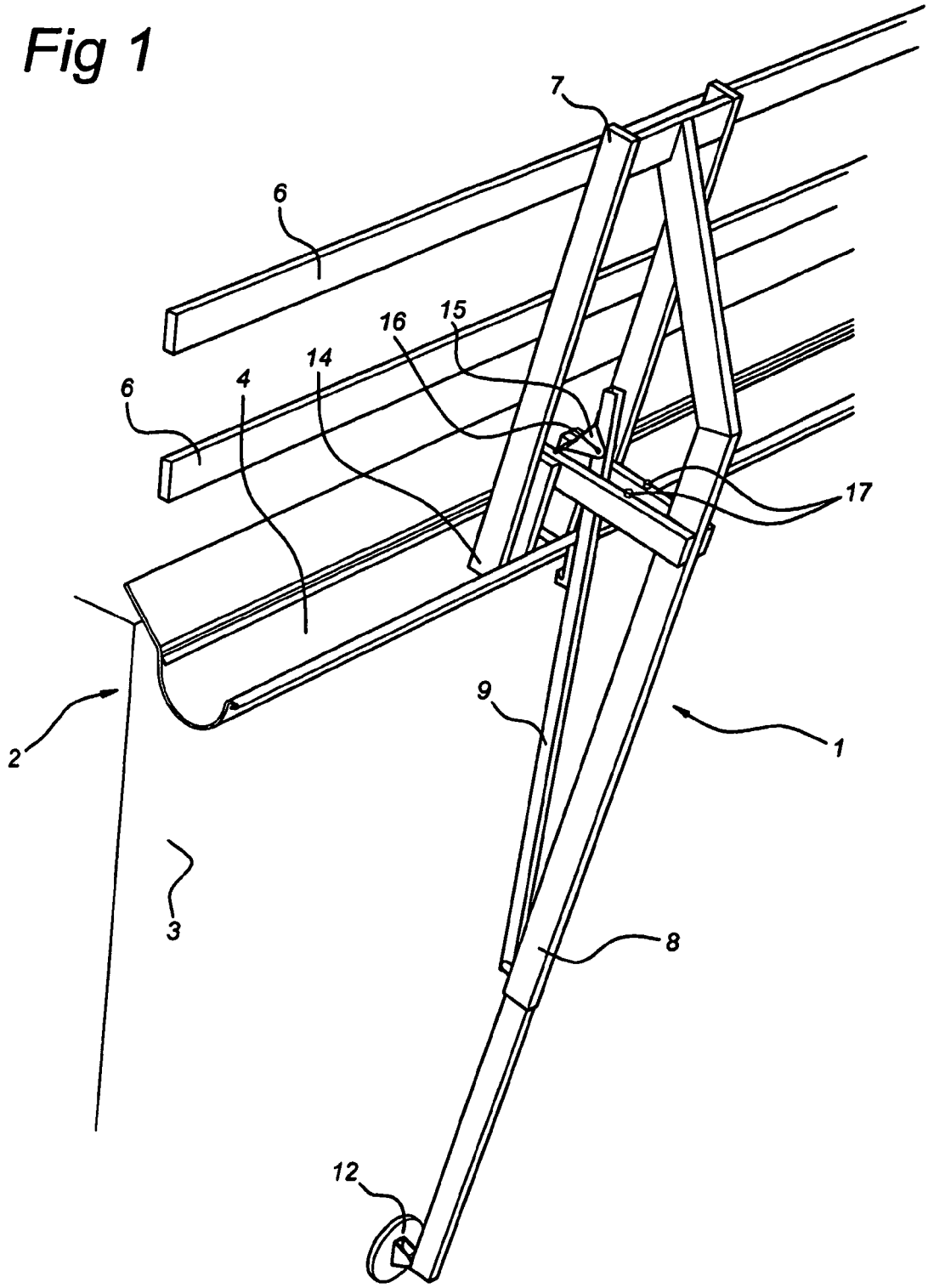
FIG. 1 shows, diagrammatically, a perspective view of a safety installation for the edge of a roof according to the present invention.
Figure 2:
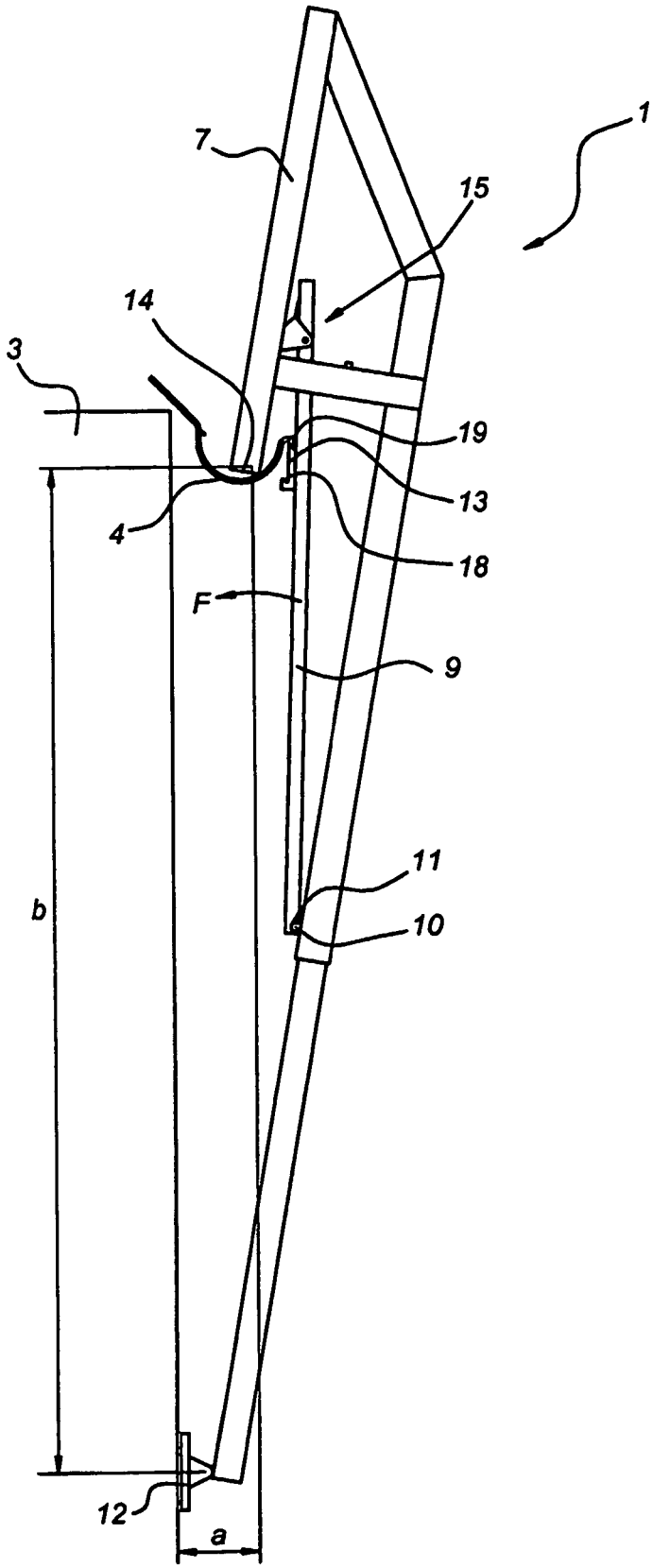
FIG. 2 shows a side view of the safety installation for the edge of a roof according to FIG. 1.

In FIGS. 1 and 2 the safety installation for the edge of a roof according to the present invention is indicated in its entirety by 1. This installation is intended to provide safety for persons working on an edge of the roof of a building 2. The outside wall of the building is indicated by 3 and the roof gutter extending along the edge of the roof by 4. The safety installation for the edge of a roof consists of an upright 7 that is essentially vertical (in the use position) and to which an arm 8 has been rigidly fixed. Arm 8 is of telescopic construction and is provided with the bearing surface 12 close to the free end. As a result of the telescopic construction the position of bearing surface 12 can be changed to some extent to take account of any obstacles on the outside wall or non-load-bearing parts thereof. There are clamping means, which are not shown, to lock the telescopic parts of arm 8 with respect to one another. The bearing surface of the upright 7 is indicated by 14. The distance between the bearing surfaces 12 and 14 is indicated by b (FIG. 2) and this distance is preferably 1.5-2.5 m.

An auxiliary arm 9 is connected to arm 8 via hinge 10. There is a spring 11 that drives said auxiliary arm 9 to the left in FIGS. 1 and 2. There is an engagement block 13, provided with engagement surfaces 18 and 19, on auxiliary arm 9. The engagement block 13 can be either adjustable or replaceable for optimum matching to the construction concerned. A fixed position is also possible.

Figure 3:
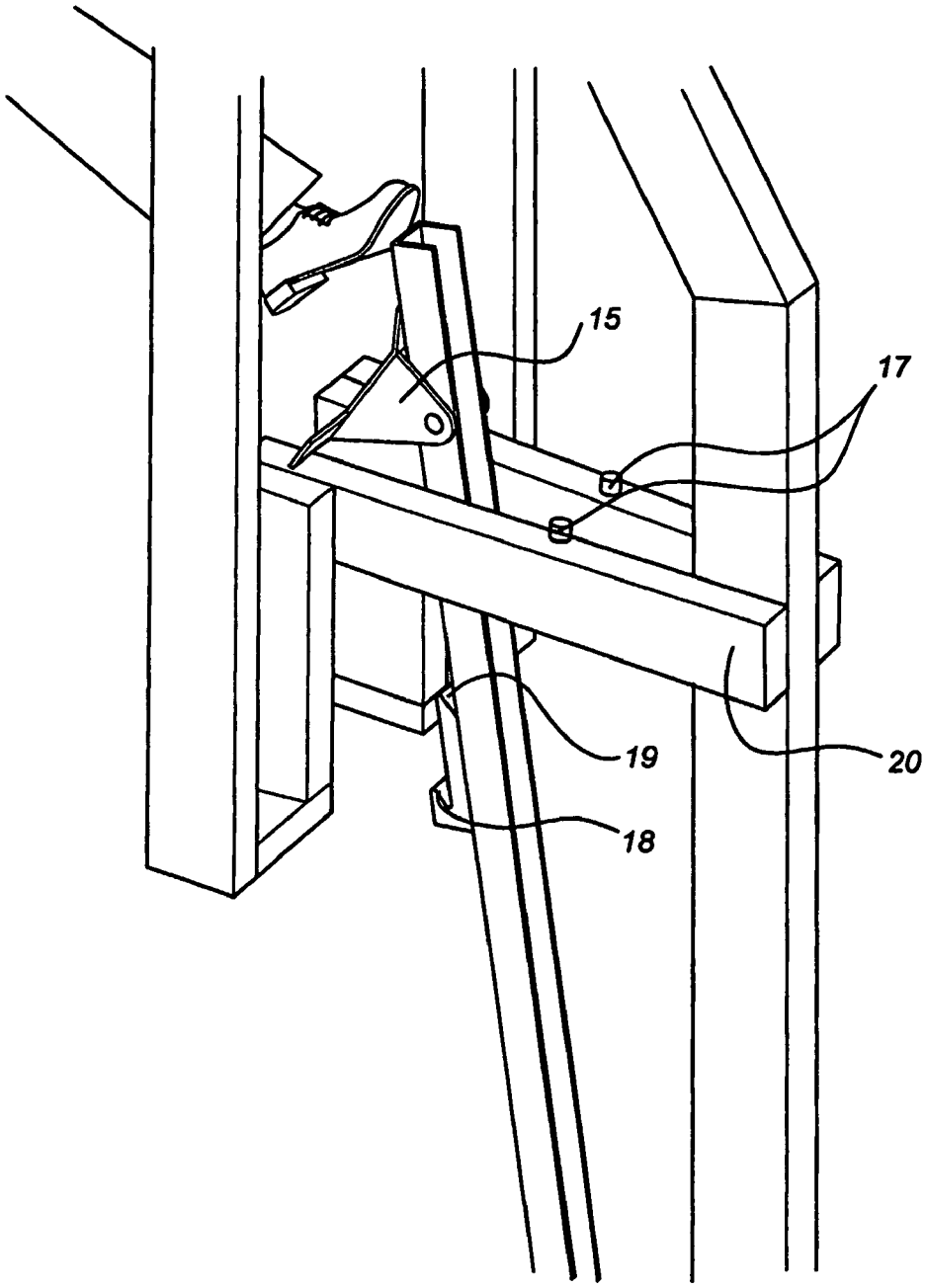
FIG. 3 shows a detail of the locking construction for the safety installation for the edge of a roof in the securing position.

The auxiliary arm 9 is provided with a lock at the top. As can be seen from FIGS. 3 and 4 this lock consists of a locking lip 15 that is fixed to auxiliary arm 9 by a joint 16, such that it can pivot. Optionally there is a spring that causes the locking lip to pivot to the left so that it slides over beam 20. This beam 20 is provided with pins 17.

The safety installation for the edge of a roof described above functions as follows. The safety installation for the edge of a roof is picked up by arm 8 or upright 7 and hung with bearing surface 14 in gutter 4 or a roof trim or the like. During this operation the auxiliary arm is in the locked position. Following installation, the auxiliary arm 9 is turned a little to the right and as soon as support surface 14 has reached the lowest point thereof, auxiliary arm 9 is able to move to the left and one of the engagement surfaces 18 or 19 can engage underneath the roof gutter 4. The securing part of the auxiliary arm 9 will be positioned relative to the bearing surface depending on the overhang of the gutter or edge of the roof. In FIGS. 1 and 2 the bearing surface 14 and engagement block 13 are a relatively short distance apart. If, however, the roof is a flat roof bearing surface 14 will often be shifted further to the left (as seen in FIG. 2). With the construction according to the present invention it is possible to provide for adaptation in a simple manner because the position of the engagement block 13 with respect to the first bearing surface 14 is adjustable in the horizontal direction. On tilting further, support surface 12 will then bear on outside wall 3. After installing a number of such safety installations, a railing 6 can be fitted and the safety installation for the edge of a roof is complete. Because of the engagement surfaces 18 and 19, respectively, it is not possible for the safety installation for the edge of a roof to move upwards, as a result of which support surface 14 could be moved out of gutter 4.

Figure 4:
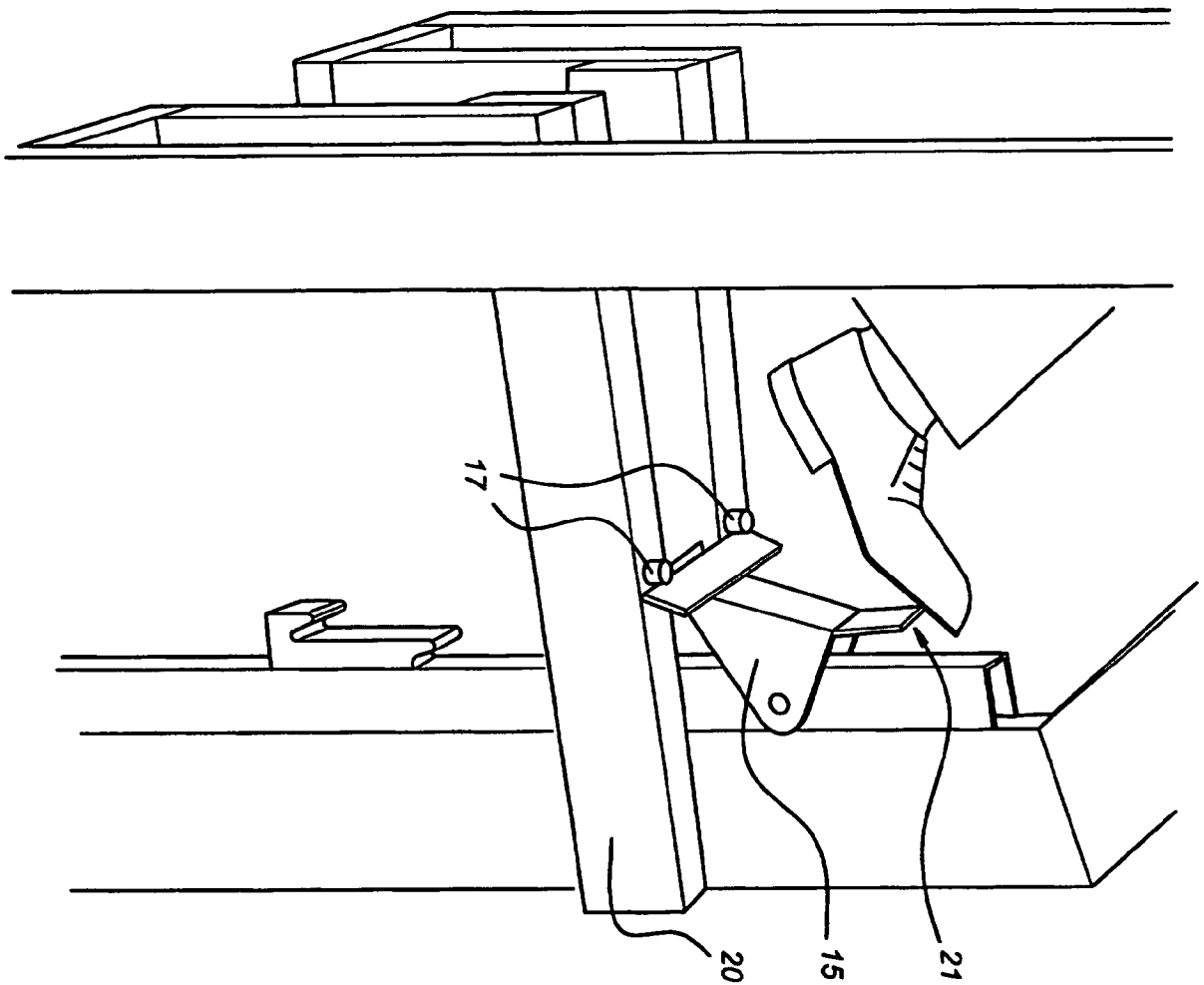
FIG. 4 shows the detail according to FIG. 3 (in a different view) in the locking position.

If it is desired to remove the safety installation for the edge of a roof, railing 6 must first be removed. Using the foot, auxiliary arm 9 can then be turned to the right, locking lip 15 moving over pins 17 and being locked behind them, as is shown in FIG. 4. At this point in time there is no longer a safety feature preventing lifting of upright 7 out of gutter 4 and the safety installation for the edge of a roof can be removed.

Of course, it is also possible to keep auxiliary arm 9 in the furthest right position as shown in FIG. 4 when installing and only after installation to cancel the engagement behind the pins 17 by pushing on the top 21 of the locking lip 15.

Figure 5:
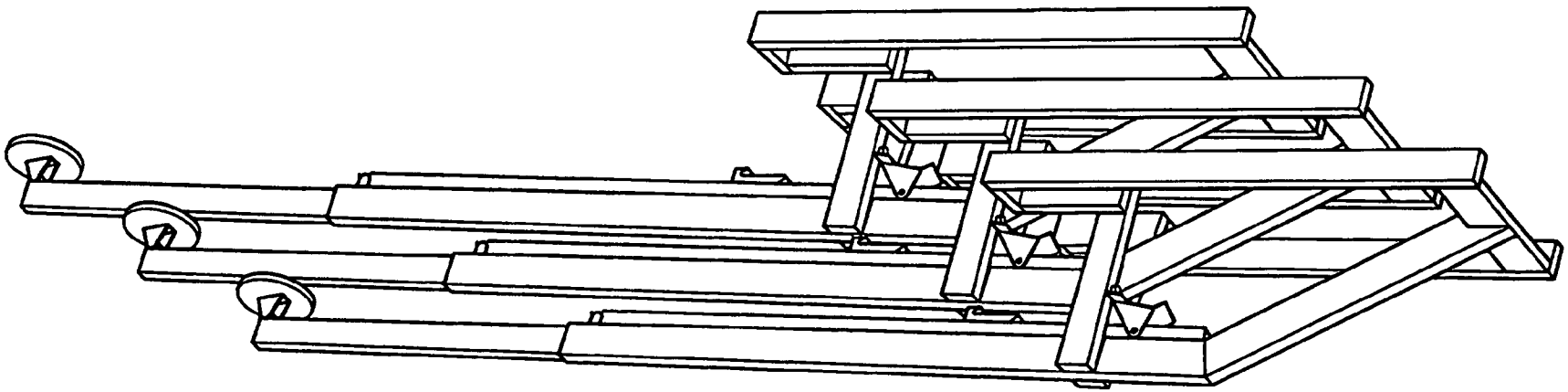
FIG. 5 shows a side view of the storage position of various parts described above.

It can be seen from FIG. 5 that after use the safety installations 1 for the edge of a roof described above can be nested in one another for efficient transport and storage.

Figure 6:
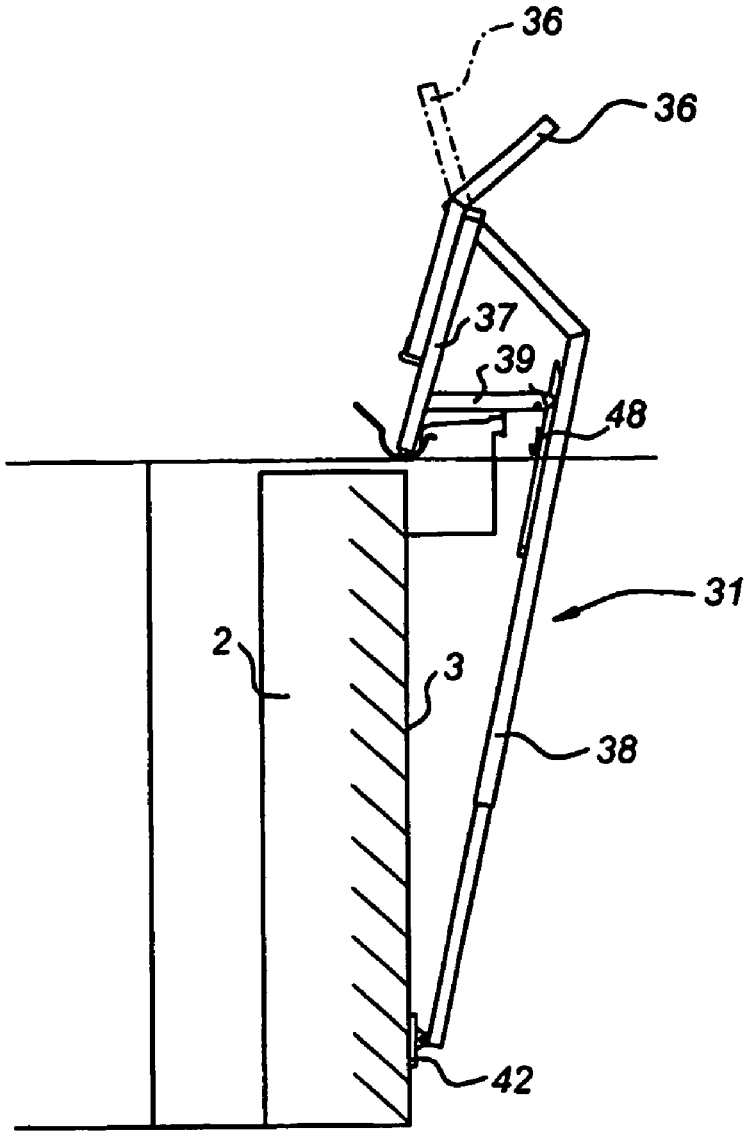
FIG. 6 shows, diagrammatically, a variant of the safety installation for the edge of a roof according to the present invention.

In FIG. 6 a variant of the safety installation for the edge of a roof described above is indicated in its entirety by 31. Bearing surface 42 is joined to arm 38, which is joined to upright 37 via cross-link 39. Cross-link 39 can be made adjustable but it is also possible to provide a rigid fixing between parts 37 and 38. A fencing-like construction 36, the functioning of which is comparable to that of railing 6, is fitted on upright 37. Broken lines indicate that this construction can be mounted in two positions, depending on the angle of the installation. Thus, the positioning of the railing can be determined depending on the overhang. As in the previous variant, upright 37 bears on a gutter or other elevation on the edge of the roof of the building 2.

A further variant is possible that essentially corresponds with what has been shown in FIG. 6. However, the part that can be slid out of the arm is constructed as an angled part so that if the distance between the gutter and the outside wall of the building is large, stable positioning can nevertheless be obtained. Although this cannot be seen in FIG. 6, the upright is of dual construction, as in the case of the embodiment first described, and consists of two parts some distance apart between which the arm extends. An adjustable engagement surface is provided that can engage underneath a roof edge or the like and prevents upward movement of the safety installation for the edge of a roof. Instead of being adjustable, such a safety feature can consist of a number of successive engagement surfaces in the vertical direction.

Although the invention has been described above with reference to a preferred embodiment of the safety installation for the edge of a roof, it will be immediately apparent to those skilled in the art that many variants are possible without going beyond the scope of the present application. Such variants will be immediately obvious to those skilled in the art after reading the above description and fall within the scope of the appended claims.

The invention claimed is:

1. A safety assembly for an edge of a roof of a building comprising:

an upright having a free bottom end, the upright extending essentially vertically in its operative position and located beyond the edge of said roof, thereby defining the boundary of said roof, and wherein said upright is equipped for joining a railing thereto;

a first bearing surface located at said free bottom end of said upright, an arm joined to said upright and having a free end extending downwards therefrom;

a second bearing surface located at said free end of said arm;

said second bearing surface for bearing against a wall of said building;

securing means designed to engage on an edge of a roof or gutter from below while said first bearing surface of said upright engages from above, said securing means being adjustable in a horizontal direction with respect to said first bearing surface, wherein said securing means comprises an auxiliary arm having an engagement surface, and wherein said auxiliary arm is hingedly joined at a point to said arm, and said engagement surface of said auxiliary arm is above the point which the auxiliary arm hinges; and a beam extending between said upright and said arm.

2. The safety assembly according to claim 1, wherein said securing means can be moved between a securing and a non-securing position.

3. The safety assembly according to claim 2, wherein said securing means comprise locking means that can be operated for fixing in the non-securing position.

4. The safety assembly according to claim 1, wherein there are driving means that drive the securing means into a securing position.

5. The safety assembly according to claim 1, wherein a distance in the horizontal direction between the first and second bearing surface is adjustable.

6. The safety assembly according to claim 1, wherein a distance in the vertical direction between the first and second bearing surface is adjustable.

7. The safety assembly according claim 1, wherein said first bearing surface comprises a wheel.

8. The safety assembly according to claim 1, which is constructed such that it can be nested with other correspondingly constructed safety assemblies for the edge of a roof.

9. A system comprising a number of safety assemblies for the edge of a roof with railing fitted between each of the safety assemblies, each safety assembly comprising:

an upright having a free bottom end, the upright extending essentially vertically in its operative position and located beyond the edge of said roof, thereby defining the boundary of said roof, and wherein said upright is equipped for joining a railing thereto;

a first bearing surface located at said free bottom end of said upright, an arm joined to said upright and having a free end extending downwards therefrom;

a second bearing surface located at said free end of said arm;

said second bearing surface for bearing against a wall of said building;

securing means designed to engage on an edge of a roof or gutter from below while said first bearing surface of said upright engages from above, said securing means being adjustable in a horizontal direction with respect to said first bearing surface, wherein said securing means comprises an auxiliary arm having an engagement surface designed to engage from below on an edge of said roof or gutter, and wherein said auxiliary arm is hingedly joined at a point to said arm, and said engagement surface of said auxiliary arm is above the point at which the auxiliary arm hinges; and a beam extending between said upright and said arm.

10. System according to claim 9, wherein said railing comprises a fencing-like V-shaped kinked barrier.

* * * * *